US011373795B2

(12) United States Patent
Yen

(10) Patent No.: US 11,373,795 B2
(45) Date of Patent: Jun. 28, 2022

(54) TRANSFORMER DEVICE

(71) Applicant: Realtek Semiconductor Corporation, Hsinchu (TW)

(72) Inventor: Hsiao-Tsung Yen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 681 days.

(21) Appl. No.: 16/375,062

(22) Filed: Apr. 4, 2019

(65) Prior Publication Data

US 2019/0392980 A1 Dec. 26, 2019

(30) Foreign Application Priority Data

Jun. 22, 2018 (TW) ..... 107121577

(51) Int. Cl.
*H01F 27/28* (2006.01)
*H01F 27/29* (2006.01)
*H01F 17/00* (2006.01)

(52) U.S. Cl.
CPC ..... *H01F 27/2804* (2013.01); *H01F 17/0033* (2013.01); *H01F 27/2828* (2013.01); *H01F 27/29* (2013.01); *H01F 2017/0073* (2013.01); *H01F 2027/2809* (2013.01); *H01F 2027/2819* (2013.01)

(58) Field of Classification Search
CPC ..... H01F 27/2804; H01F 27/2828
USPC ..... 336/226
See application file for complete search history.

(56) References Cited

U.S. PATENT DOCUMENTS 7,233,224 B2 * 6/2007 Strzalkowski ..... H01F 27/2804 336/200
7,982,571 B2 * 7/2011 Gianesello ..... H01F 21/12 336/200
9,824,812 B2 11/2017 Huang et al.
10,153,078 B2 12/2018 Yen et al.
(Continued)

FOREIGN PATENT DOCUMENTS

TW 201537592 A 10/2015
TW 201546843 A 12/2015

OTHER PUBLICATIONS

U.S. Appl. No. 16/155,058, filed Oct. 9, 2018.
China Patent Office, Office Action of the corresponding Chinese application No. 201810717238.4 dated Mar. 25, 2021.

*Primary Examiner* — Ronald Hinson
(74) *Attorney, Agent, or Firm* — Locke Lord LLP; Tim Tingkang Xia, Esq.

(57) ABSTRACT

A transformer device includes first conductive segments, second segments, and third conductive segments. The second segments include second conductive segments and first bridging segments. The first bridging segments are connected to the first conductive segments to form a first inductor. The third conductive segments include second bridging segments, and the third conductive segments are connected to the second conductive segments to form a second inductor. The first inductor is located on the second inductor. The first bridging segments and the first conductive segments form first interlaced portions along a first direction. The second bridging segments and the second conductive segments form second interlaced portions along a second direction. The first direction is different from the second direction.

20 Claims, 12 Drawing Sheets

(56) References Cited

U.S. PATENT DOCUMENTS

| | | | | |
|---|---|---|---|---|
| 2004/0075521 | A1* | 4/2004 | Yu | H01L 27/08 336/200 |
| 2004/0108933 | A1* | 6/2004 | Chen | H01L 27/08 336/200 |
| 2009/0261935 | A1* | 10/2009 | Hisamitsu | H01F 17/0006 336/200 |
| 2010/0164667 | A1* | 7/2010 | Ho-Hsiang | H01F 27/34 336/200 |
| 2011/0006872 | A1* | 1/2011 | Nazarian | H01F 17/0006 336/226 |
| 2011/0032067 | A1* | 2/2011 | Le Guillou | H01F 27/346 336/200 |
| 2011/0221560 | A1* | 9/2011 | Chen | H01F 17/0013 336/200 |
| 2013/0265132 | A1* | 10/2013 | Huang | H01F 27/29 336/200 |
| 2015/0170824 | A1* | 6/2015 | Tesson | H01F 27/2804 336/190 |
| 2015/0364243 | A1 | 12/2015 | Yen et al. | |
| 2016/0112015 | A1* | 4/2016 | Chen | H01F 27/2804 336/170 |
| 2016/0125995 | A1* | 5/2016 | Armanious | H01F 17/0006 336/189 |
| 2019/0088734 | A1 | 3/2019 | Yen | |

* cited by examiner

TRANSFORMER DEVICE

CROSS REFERENCE TO RELATED APPLICATION

This application claims priority to Taiwan Application Serial Number 107121577, filed on Jun. 22, 2018, which is herein incorporated by reference.

BACKGROUND

Technical Field

This present disclosure relates to a transformer device, and in particular to a transformer device with a stacked inductor.

Description of Related Art

Inductors are passive components commonly found in circuit systems. Depending on the actual needs, the inductors may be used for filtering, energy storage, or wireless coupling. For example, a transformer may be implemented by two inductors coupled with each other.

In the application of integrated circuits, the stacked inductors are usually used in order to reduce area occupied by the inductors. However, the arrangement in the prior art causes the inductor with a lower quality factor.

SUMMARY

Some aspects of the present disclosure are to provide a transformer device including first conductive segments, second segments, and third conductive segments. The first conductive segments are formed on a first metal layer. The second segments are formed on a second metal layer, and include second conductive segments and first bridging segments, wherein the first bridging segments are connected to the first conductive segments to form a first inductor. The third conductive segments are formed on a third metal layer, and include second bridging segments, wherein the third conductive segments are connected to the second conductive segments to form a second inductor. The first inductor is located on the second inductor. The first bridging segments and the first conductive segments form first interlaced portions along a first direction. The second bridging segments and the second conductive segments form second interlaced portions along a second direction. The first direction is different from the second direction.

Based on the above, in embodiments of the present disclosure, the conductive segments in the different layers are connected by bridging segments in different directions to form inductors. In this way, the quality factor of the inductor can be effectively improved in a unit area, thereby improving the performance of the transformer device.

BRIEF DESCRIPTION OF THE DRAWINGS

The drawings in the present disclosure is described as follows.

DETAILED DESCRIPTION

For ease of understanding, like elements in the following figures are designated with the same reference numbers.

Figure 1A:
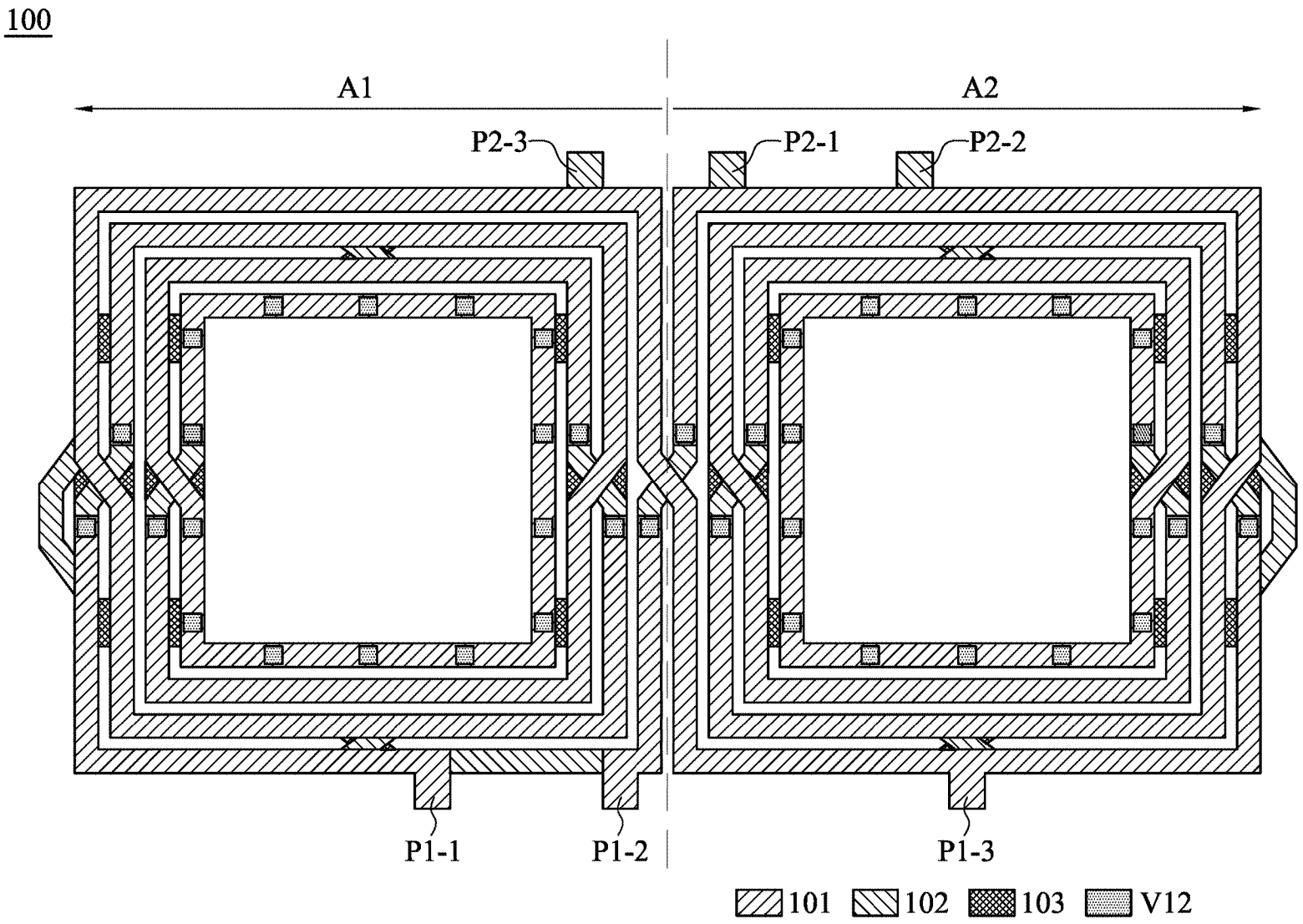
FIG. 1A is a schematic diagram of the transformer device according to some embodiments of the present disclosure.

Referring to FIG. 1A, FIG. 1A is a schematic diagram of a transformer device 100 depicted according to some embodiments of the present disclosure.

Figure 1B:
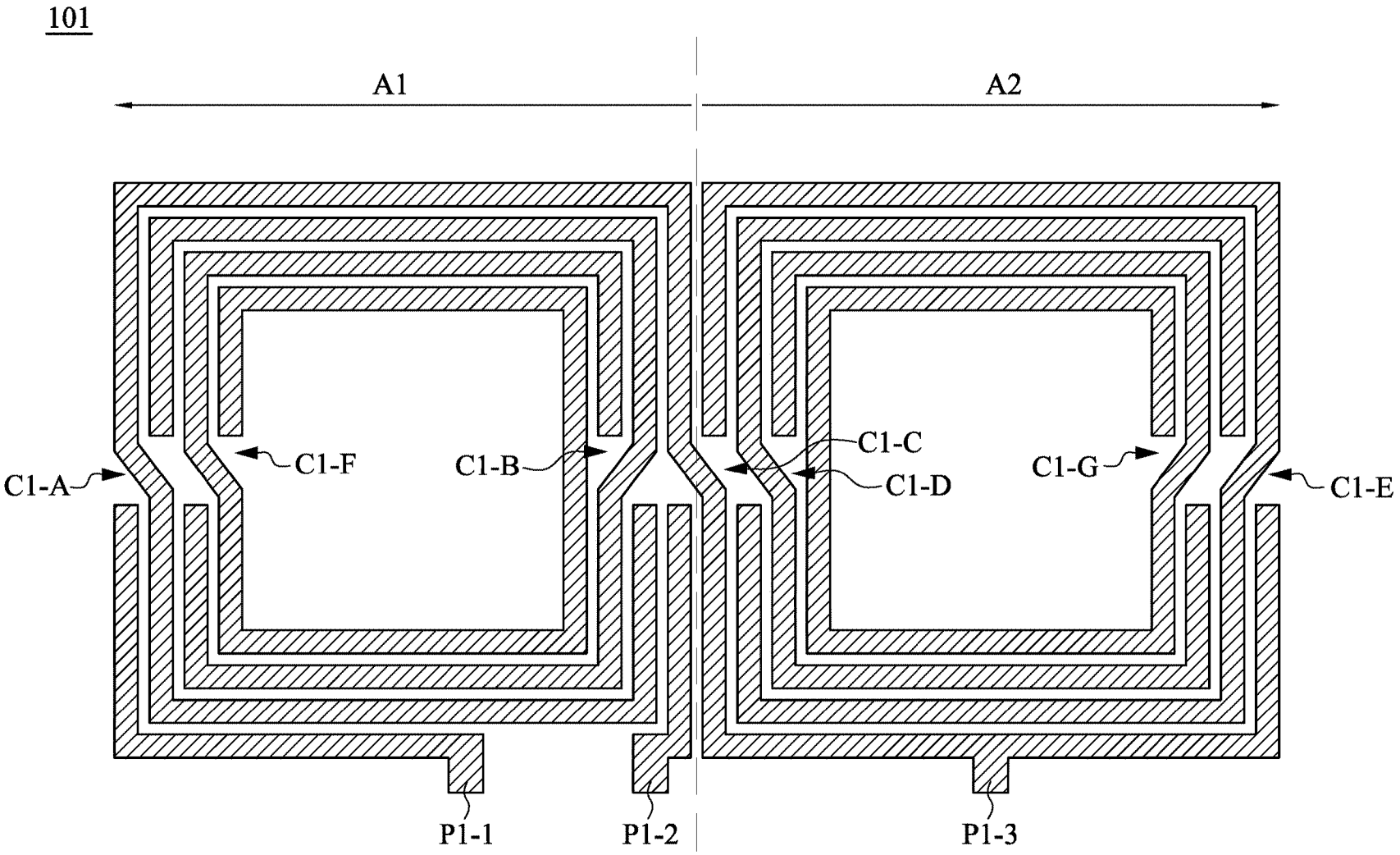
FIG. 1B is a schematic diagram of the conductive segments in FIG. 1A according to some embodiments of the present disclosure.
Figure 1C:
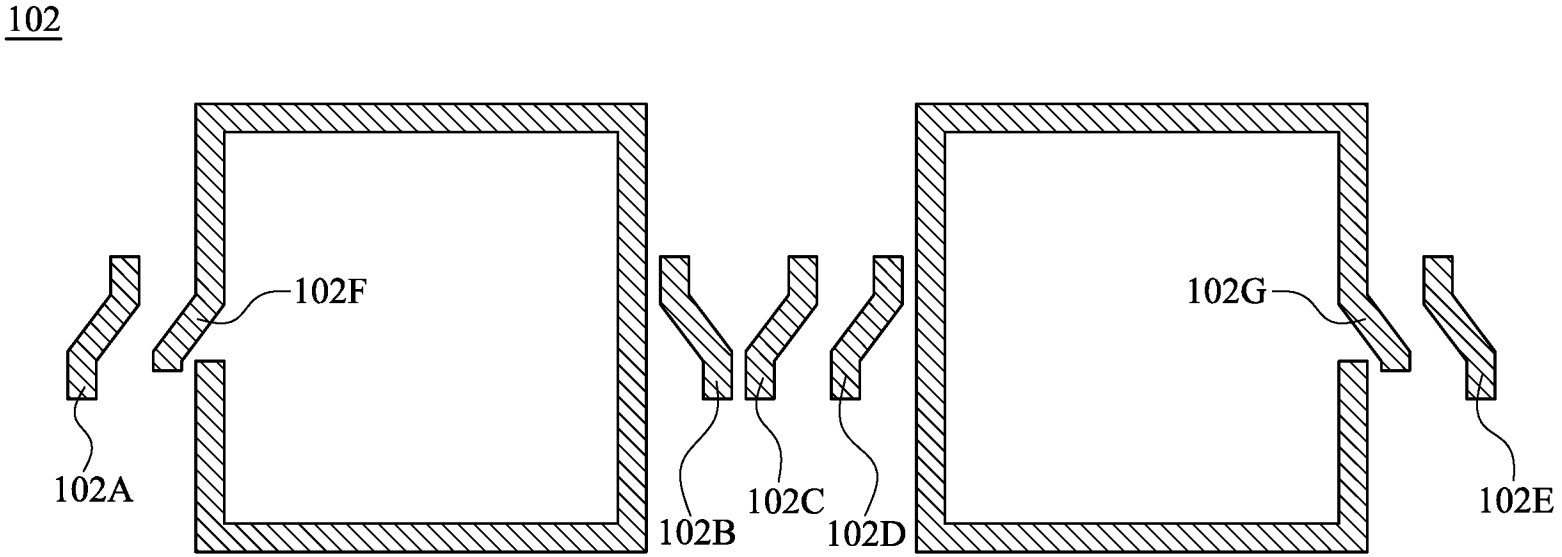
FIG. 1C is a schematic diagram of the partial conductive segments in FIG. 1A according to some embodiments of the present disclosure.
Figure 1D:
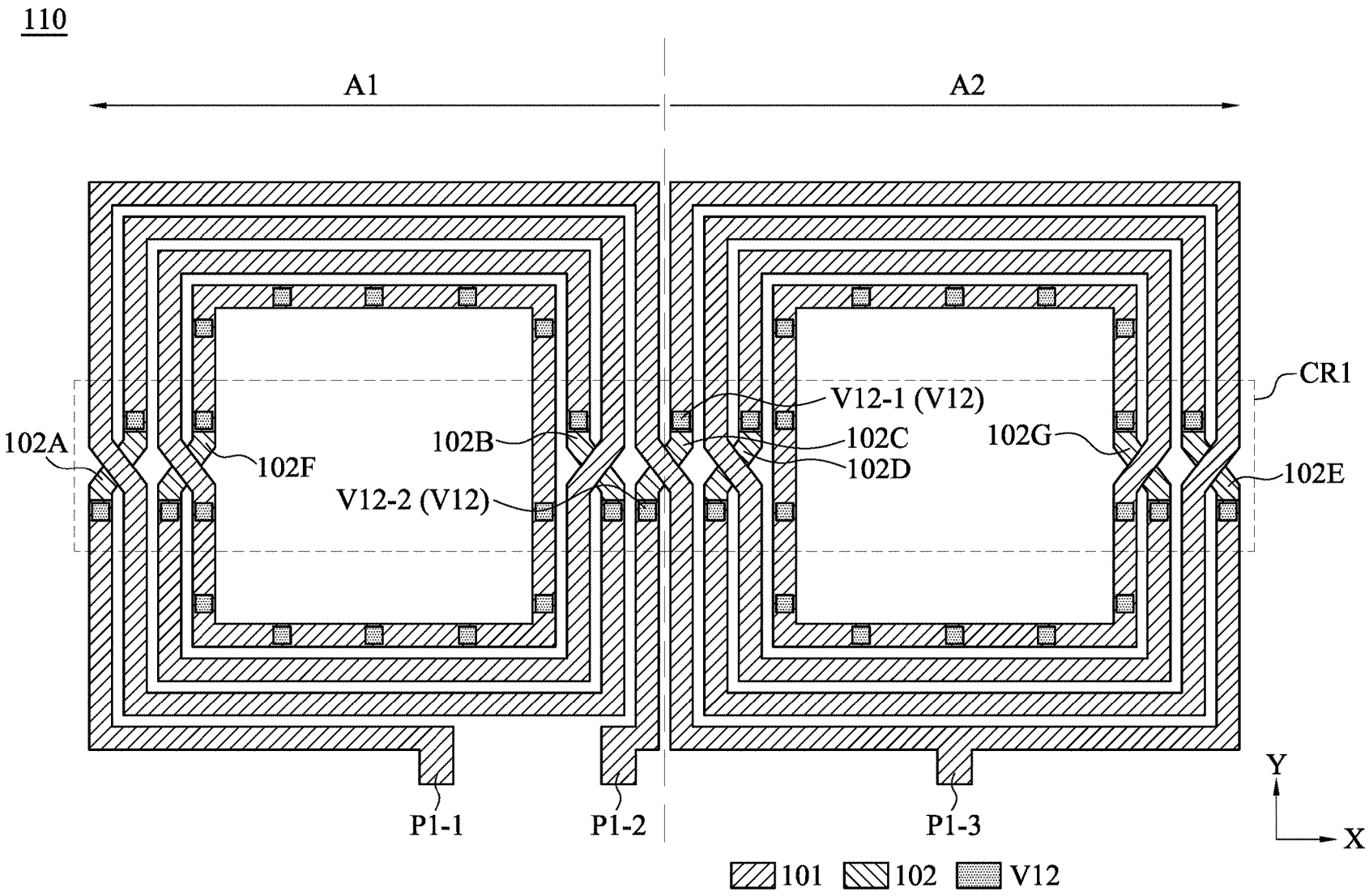
FIG. 1D is a schematic diagram of the inductor formed by the conductive segments in FIGS. 1B and 1C according to some embodiments of the present disclosure.
Figure 1E:
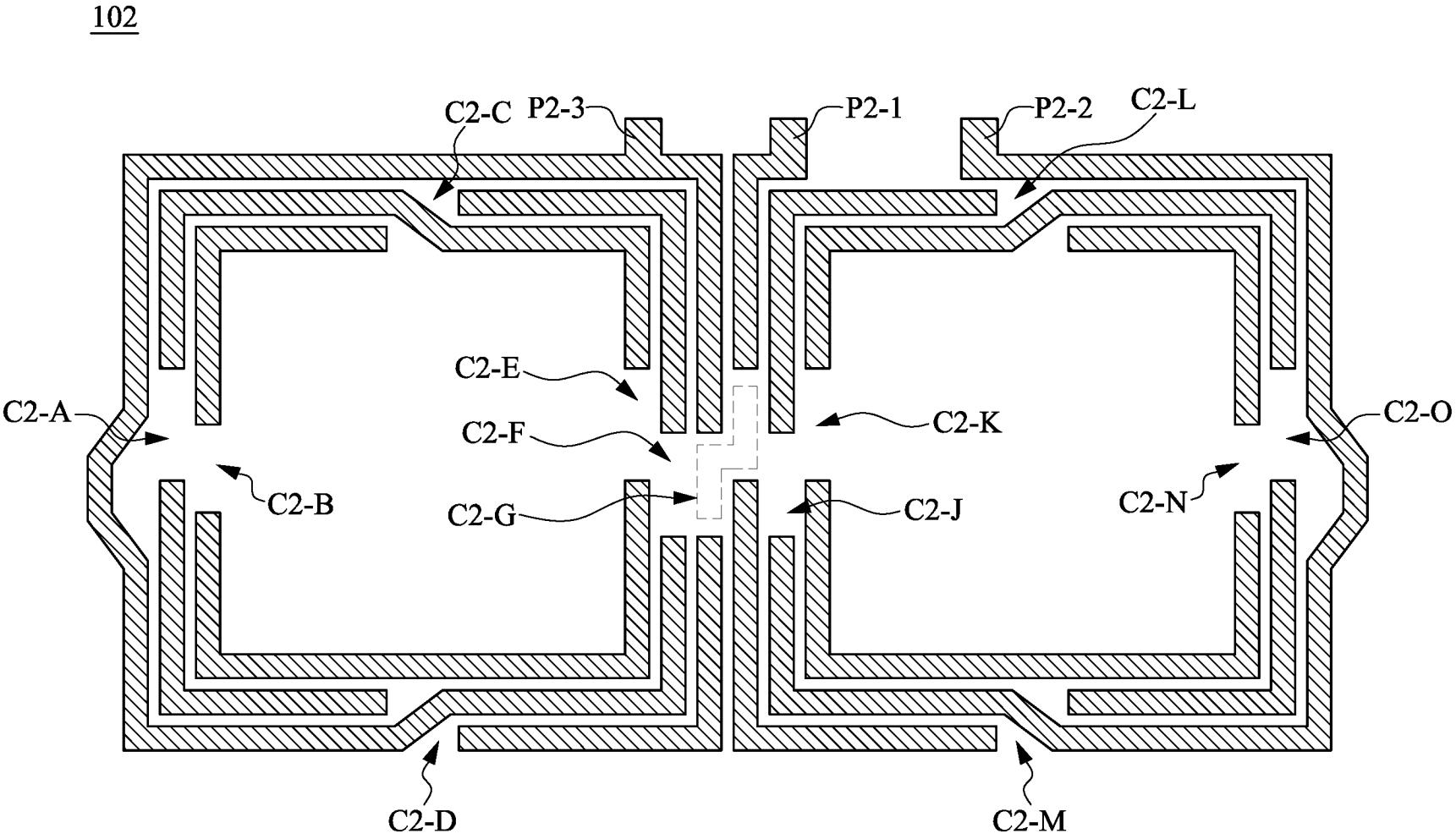
FIG. 1E is a schematic diagram of the configuration of the partial conductive segments in FIG. 1A according to some embodiments of the present disclosure.
Figure 1F:
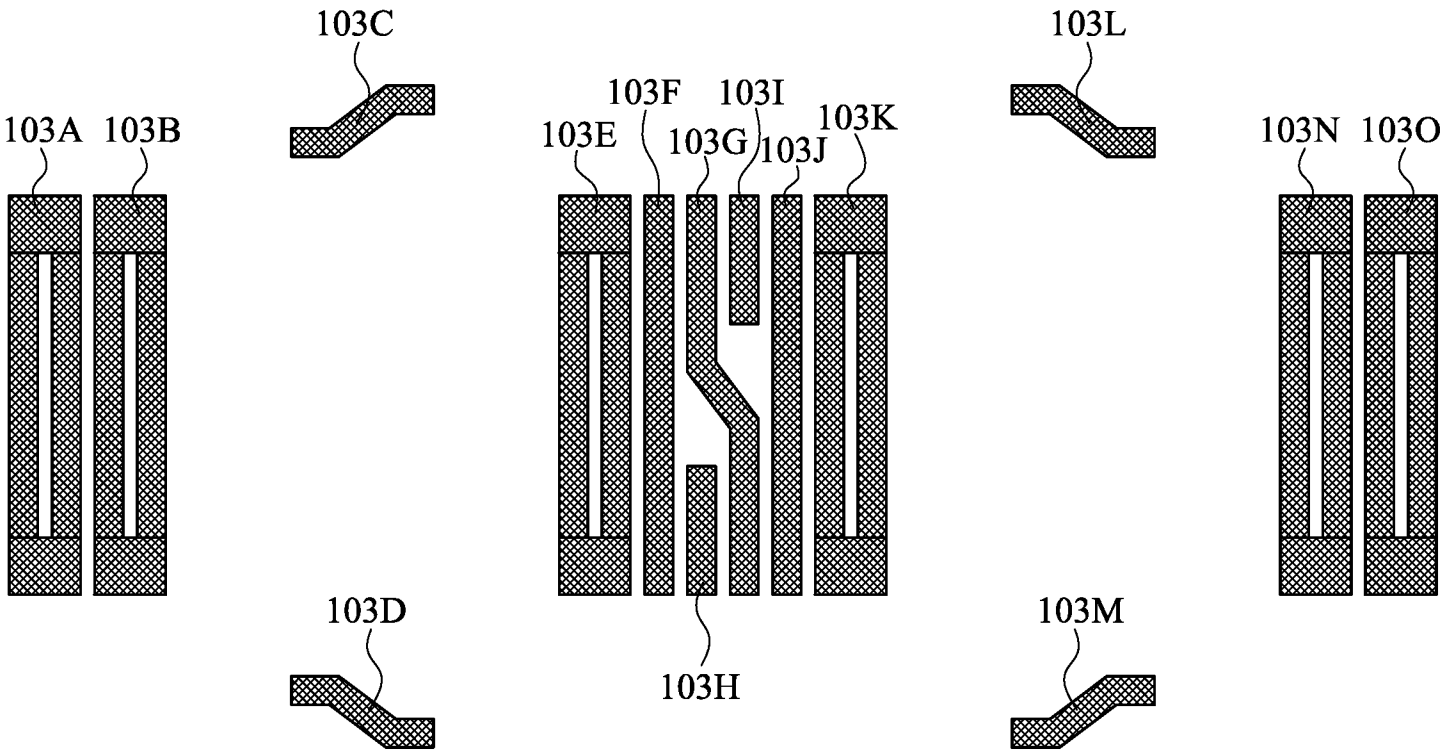
FIG. 1F is a schematic diagram of the configuration of the conductive segments in FIG. 1A according to some embodiments of the present disclosure.
Figure 1G:
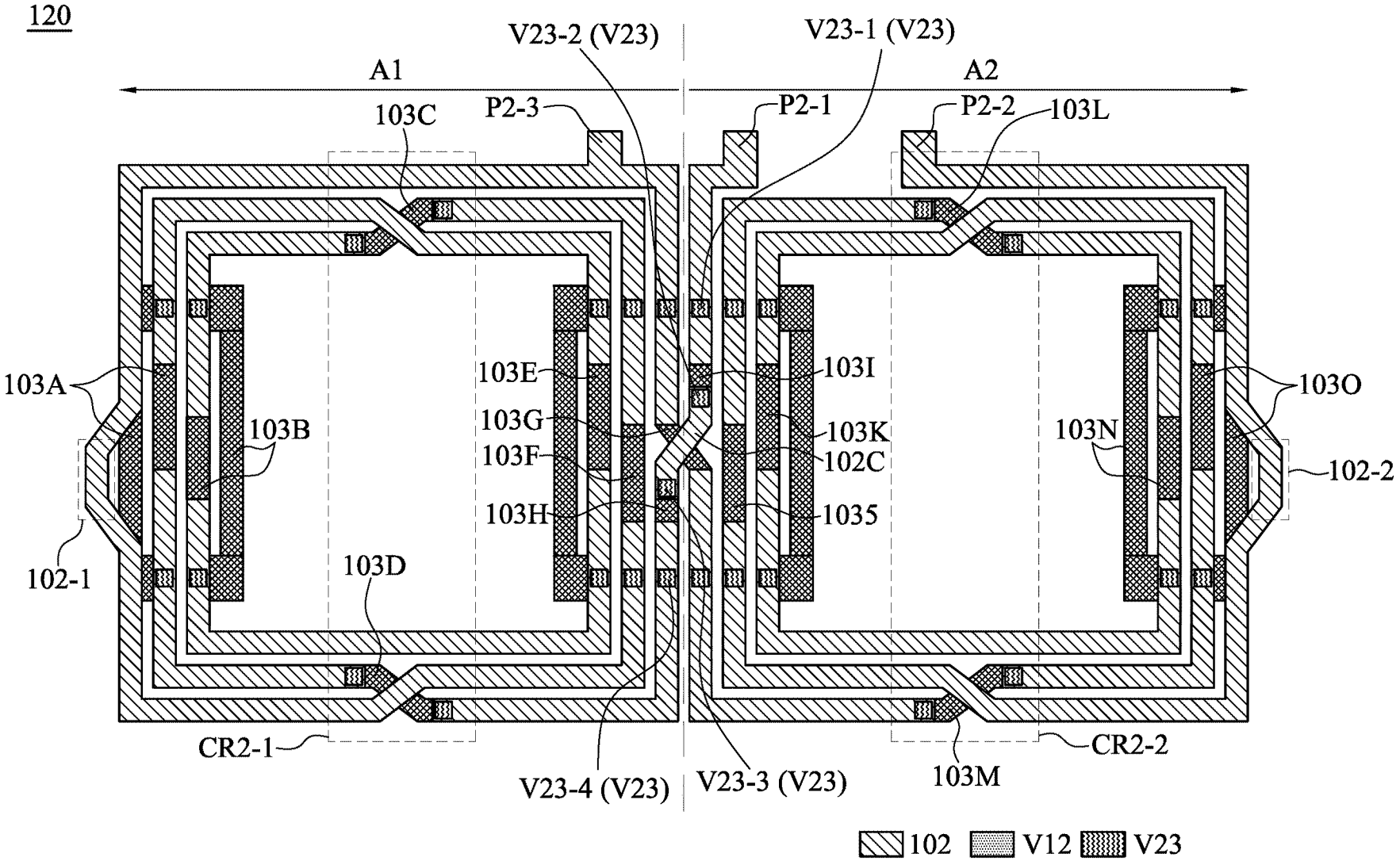
FIG. 1G is a schematic diagram of the configuration of the inductor formed by the conductive segments in FIGS. 1E and 1F according to some embodiments of the present disclosure.

In some embodiments, the transformer device 100 includes conductive segments 101-103 and vias V12 and V23, in which the via V23 is located below conductive segments 101 (as shown in FIG. 1G). The conductive segments 101-103 and the vias V12 and V23 may form two overlapped inductors (e.g., an inductor 110 in FIG. 1D and an inductor 120 shown in FIG. 1G).

In some embodiments, the conductive segments 101, 102, and 103 are implemented by different metal layers. In some embodiments, the conductive segments 101 and 102 may be implemented by two metal layers having the lowest resistance values in a manufacturing process to improve the performance of the transformer device 100. For example, the conductive segments 101 are implemented by an ultra-thick metal (UTM) layer, the conductive segments 102 are implemented by a redistribution layer (RDL), and the conductive segments 103 are implemented by a metal layer M6, in which the UTM layer, the RDL, and the metal layer M6 are top metal layers in the manufacturing process. The resistance value of the UTM layer is lower than the resistance value of the RDL, and the resistance value of the RDL is lower than the resistance value of the metal layer M6. In addition, the UTM layer is stacked on the RDL, and the RDL is stacked on the metal layer M6. In some embodiments, the vias V12 or V23 may be implemented by via structures, an array of vias, or through-silicon vias. The vias V12 or V23 may be implemented by various conductive materials to connect different conductive segments.

The implementations and the number of the conductive segments 101-103 and vias V12-V23 above are used for illustrative purposes, and various other metal layers/conductive material which are suitable to implement the conductive segments 101-103 and the vias V12-V23 are also covered by the scope of the present disclosure. For example, the metal layer M6 may be a set of any metal layers, for example, metal layers M4-M6 coupled in parallel.

The vias V12 are configured to couple at least one of the conductive segments 101 to at least one of the conductive segments 102, correspondingly. The vias V23 are disposed below the conductive segments 101, and are configured to couple at least one of the conductive segments 102 to at least one of the conductive segments 103, correspondingly. The related arrangement will be described below.

Referring to FIGS. 1A-1D, FIG. 1B is a schematic diagram of the conductive segments 101 in FIG. 1A according to some embodiments of the present disclosure, FIG. 1C is a schematic diagram of a part of the conductive segments 102 in FIG. 1A according to some embodiments of the present disclosure, and FIG. 1D is a schematic diagram of the inductor 110 formed by the conductive segments 101 and 102 in FIGS. 1B and 1C according to some embodiments of the present disclosure.

The bridging segments 102A-102E (i.e. part of the conductive segments 102) in FIG. 1C are disposed corresponding to the conductive segments 101 in FIG. 1B. As shown in FIG. 1D, the bridging segments 102A-102G are configured to correspond to disconnected portions C1-A to C1-G between the conductive segments 101 in FIG. 1B, respectively, in which the conductive segments 101 are stacked over the bridging segments 102A-102G. The vias V12 are configured to correspond to two ends of the bridging segments 102A-102G, in order to couple the bridging segments 102A-102G to the conductive segments 101.

In some embodiments, the conductive segments 101 of FIG. 1B and the bridging segments 102A-102G in FIG. 1C are coupled to each other through the vias V12 to form the inductor 110. For example, the conductive segments 101 in a first region A1 are disposed from a first port P1-1 of the inductor 110 sequentially through an outer turn of the first region A1 and the bridging segments 102A, 102F, and 102B, and coupled to the outer turn in the first region A1 adjacent to a second region A2. The conductive segments 101 in the second region A2 are disposed from the outer turn in the first region A1 sequentially through an outer turn of the second region A2, a third port P1-3 of the inductor 110, and the bridging segments 102E, 102G, 102D, and 102C, and coupled to a second port P1-2 of the inductor 110. In some embodiments, the first port P1-1 and the second port P1-2 may operate as input/output ports, and the third port P1-3 may operate as a center tap.

In some embodiments, the conductive segments 101 form two spiral coils having windings in the first region A1 and the second region A2, respectively, in order to form an 8-shaped inductor 110. For example, as shown in FIG. 1D, the conductive segments 101 in the first region A1 are routed from the outer turn and clockwise to the inner turn, in order to form a spiral coil. The conductive segments 101 in the second region A2 are routed from the outer turn and counterclockwise to the inner turn, in order to form another spiral coil. These two coils may form the 8-shaped inductor 110. With the above arrangement, if these two spiral coils receive signals and generate a magnetic field, respectively, the magnetic field directions of these two magnetic fields are opposite and countered with each other. In this way, the noise coupling (e.g., electromagnetic interference (EMI)) may be reduced.

In addition, as shown in FIG. 1D, the vias V12 are disposed in the innermost turn of the inductor 110 to couple the conductive segments 102F-102G below (as shown in FIG. 1C). With this stacking manner, the quality factor of the inductor 110 are able to be further adjusted.

Figure 1H:
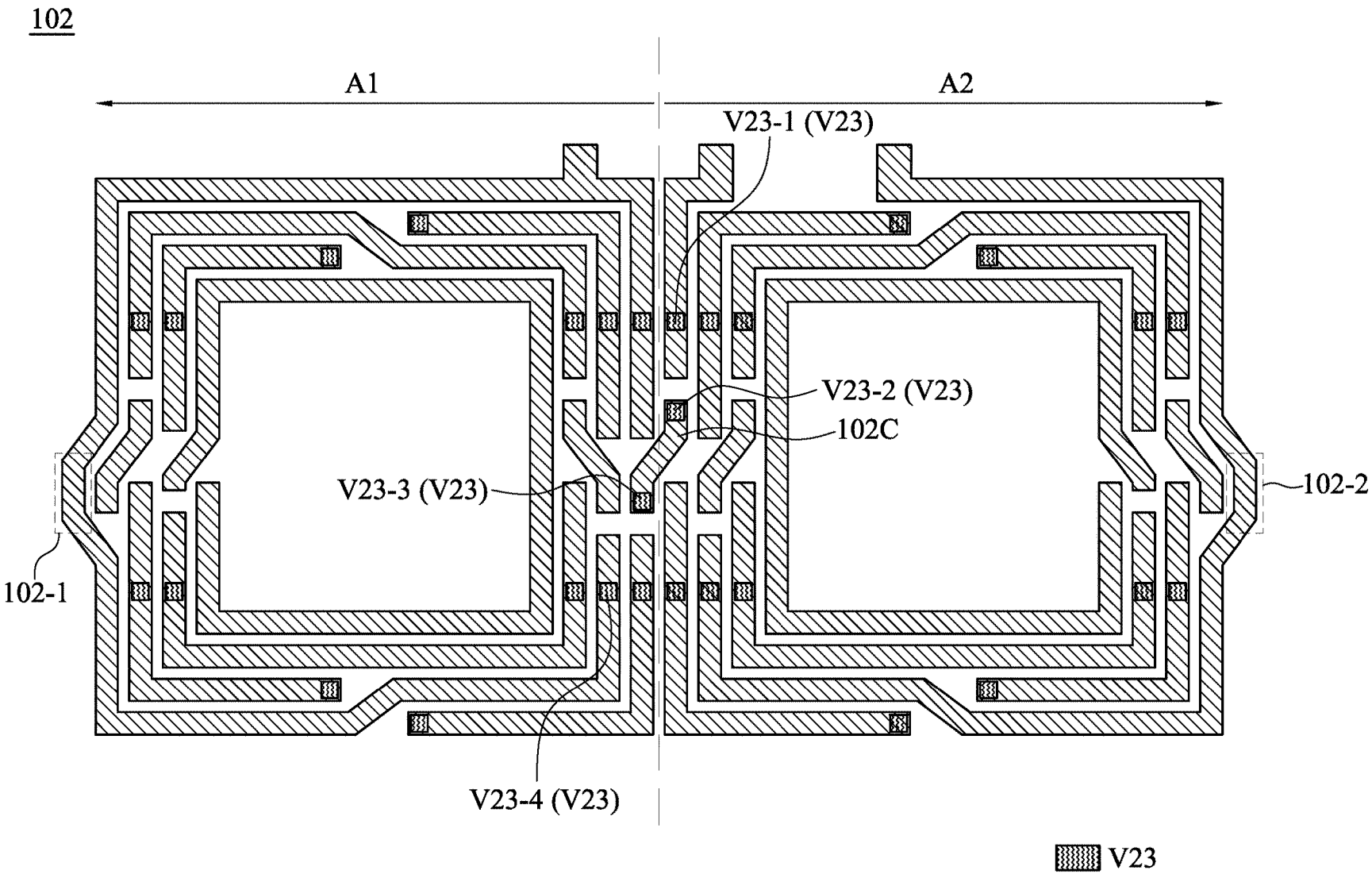
FIG. 1H is a schematic diagram of the configuration of the conductive segments in FIGS. 1C and 1E according to some embodiments of the present disclosure.

Referring to FIG. 1A and FIGS. 1E-1H, FIG. 1E is a schematic diagram of the configuration of a part of conductive segments 102 in FIG. 1A according to some embodiments of the present disclosure, FIG. 1F is a schematic diagram of the configuration of the conductive segments 103 in FIG. 1A according to some embodiments of the present disclosure, FIG. 1G is a schematic diagram of the configuration of the inductor 120 formed by the conductive segments 102 and 103 in FIGS. 1E and 1F according to some embodiments of the present disclosure, and FIG. 1H is a schematic diagram of the configuration of all of the conductive segments 102 in FIGS. 1C and 1E according to some embodiments of the present disclosure.

The conductive segments 102 in FIG. 1E are configured to correspond to bridging segments 103A-103O (i.e., the conductive segments 103) in FIG. 1F. For ease of understanding, FIG. 1G shows the arrangement of the conductive segments 102 in FIG. 1E, the bridging segment 102C in FIG. 1D, and the vias V23, and FIG. 1H merely shows the arrangement of all of the conductive segments 102 in FIG. 1A.

As shown in FIG. 1G, the bridging segments 103A-103F and 103J-103O are disposed corresponding to the disconnected portions C2-A to C2-F and C2-J to C2-O between the conductive segments 102 in FIG. 1E, respectively, and the bridging segments 103G-103I and the bridging segment 102C in FIG. 1D are disposed to correspond to the disconnected portion C2-G between the conductive segments 102 in FIG. 1E. The conductive segments 102 are stacked over the bridging segments 103A-103O. In some embodiments, portions of the bridging segments 103B, 103E, 103K, and 103N are stacked below the bridging segments 102F and 102G in FIG. 1C (as shown in FIG. 1C) to increase the coupling between the inductor 110 and inductor 120.

The vias V23 are configured to correspond to two ends of the bridging segments 103A-103O to couple the bridging segments 103A-103O to the conductive segments 102. It should be particularly noted that the bridging segment 103I is correspondingly disposed between the vias V23-1 and V23-2 (near the via V12-1 in FIG. 1D) to couple the outer turn of the second region A2 to the bridging segment 102C. Similarly, the bridging segment 103H is correspondingly disposed between the vias V23-3 (near the via V12-2 in FIG. 1D and V23-4 to couple the bridging segment 102C to the outer turn of the first region A1. In other words, in some embodiments, the bridging segment 102C may bridge the inductor 110 in FIG. 1D and the inductor 120 in FIG. 1G, simultaneously.

In some embodiments, the conductive segments 102 of FIG. 1H and the bridging segments 103A-103O in FIG. 1F are coupled to each other through the vias V23 to form the inductor 120. For example, as shown in FIG. 1G, the conductive segments 102 are routed from the first port P2-1 of the first inductor 120 sequentially through the outer turn of the second region A2, the bridging segment 103I, the bridging segment 102C, the bridging segment 103H, the outer turn of the first region A1, the bridging segments 103D, 103A, and 103E, the inner turn of the first region A1 and the bridging segments 103B, 103C, 103F, and 103A (and/or an outer turn segment 102-1 of the first region A1), the third port P2-3 of the inductor 120, and the bridging segment 103G, and the conductive segments 102 are coupled to the outer turn of the second region A2 adjacent to the first region A1. Next, the conductive segments 102 are routed from the outer turn of the second region A2 through the bridging segments 103M, 103O, 103K, the inner turn of the second region A2, and the bridging segments 103N, 103L, 103J, 103O (and/or an outer turn segment 102-2 of the second region A2), and are coupled to the second port P2-2. In some embodiments, the first port P2-1 and the second port P2-2 operate as input/output ports, and the third port P2-3 operates as a center tap.

In some embodiments, the inductor 120 may be operated without employing the outer turn segment 102-1 of the first region A1 and the outer turn segment 102-2 of the second region A2. Under these conditions, the outer turn of the inductor 120 may be connected by connecting the right side of the bridging segment 103O and the additional via V23 (not shown) and by connecting the left side of the bridging segment 103A and the additional via V23 (not shown), in which the left side and right side of the bridging segment 103A are not connected, and the left side and right side of the bridging segment 103O are not connected. Compared with the above example, as shown in FIG. 1G, since the resistance value of the RDL is lower than the resistance value of the metal layer M6, the resistance value of the trace of the inductor 120 may be further reduced with the arrangement of the outer turn segments 102-1 and 102-2, to improve the performance of the inductor 120.

In some embodiments, the conductive segments 102 in FIG. 1E and the bridging segment 102C in FIG. 1C form spiral coils in the first region A1 and the second region A2 to form an 8-shaped inductor. For example, as shown in FIG. 1G, the conductive segments 102 in the first region A1 are routed from the outer turn and clockwise to the inner turn to form a spiral coil. The conductive segments 102 in the second region A2 are routed from the outer turn and counterclockwise to the inner turn to form another spiral coil. These two coils may form an 8-shaped inductor 120, and the directions of the magnetic fields generated by these two coils are opposite to each other. As previously described, this configuration reduces noise coupling to improve the performance of the inductor 120.

Accordingly, the transformer device 100 in FIG. 1A may be formed by the inductor 110 in FIG. 1D and the inductor 120 in FIG. 1G, in which the inductor 110 is stacked over the inductor 120. In this embodiment, the transformer device 100 is formed by two asymmetric inductors 110 and 120. In some embodiments, the bridging segments 102F-102G are only used to stack the inductors 110. In this embodiment, the inductor 110 is formed by two spiral coils with 4 turns, and the inductor 120 is essentially formed by two spiral coils with 3 turns. In some embodiments, the ratio of inductance between the inductor 110 and the inductor 120 is substantially 3:2 due to the mutual inductance.

The above-mentioned transformer device 100 with the asymmetrical inductance is given for illustrative purpose, and the present disclosure is not limited thereto. The transformer device 100 may also be implemented by two symmetrical inductors depending on the different applications.

In some related approaches, implementing a transformer device by stacking two spiral inductor typically requires at least four layers of metal layers. Since the resistance values of the metal layers are different, if more metal layers are used, it may reduce the symmetry between the inductors and then may reduce the quality factor. In addition, when more metal layers are used, it may need more areas to increase the symmetry of the inductors.

Compared to the above related approaches, as previously described, the inductor 110 is formed by the conductive segments 101 disposed on a first layer (e.g., the UTM layer) and the partial conductive segments 102 disposed on a second layer (e.g., the RDL), and the inductor 120 is formed by the conductive segments 102 disposed in the second layer and the conductive segments 103 disposed on a third layer. The disconnected portion of the inductor 110 may be connected by the bridging segments 102A-102G of the second layer, and the disconnected portion of the inductor 120 may be connected by the bridging segments 103A-103O of the third layer.

As shown in FIG. 1C, the conductive segments 101 routed from the outer turn to the inner turn and the bridging segments 102A-102G form interlaced portions CR1 along the X direction. For example, the bridging segment 102A is configured to connect one turn of the spiral inductor located in the first region A1 to another turn, and is interlaced with the conductive segments 101 to form the interlaced portion CR1. By this analogy, the inductor 110 has the interlaced portions CR1 along the X direction. As shown on FIG. 1G, the conductive segments 102 routed from the outer turn to the inner turn and the bridging segments 103C, 103D, 103L, and 103M form interlaced portions CR2-1 and CR2-2 along the Y direction, in which the X direction is different from the Y direction. For example, the bridging segment 103C is configured to connect one turn of the spiral inductor located in the first region A1 to another turn, and is interlaced with the conductive segments 102 to form a part of the interlaced portion CR2-1. By this analogy, the inductor 120 has the interlaced portions CR2-1 and CR2-2 along the Y direction. Based on the above arrangement, the interlaced portions of the inductor 110 and the inductor 120 may be separated from the others. As a result, the two metal layers having the lowest resistance value (e.g., the UTM layer and the RDL) may be densely utilized in a unit area to form the inductors 110 and 120, in order to improve the performance of the transformer device 100.

In the foregoing embodiments, a square inductor is taken as an example for illustration only, and the present disclosure is not limited thereto. Various shapes (e.g., hexagonal, octagonal, etc.) of inductors are suitable for the above-mentioned configurations, and thus are also within the contemplated scope of the present disclosure. In some embodiments of the square inductor, the X direction and the Y direction may be two mutually perpendicular directions. In embodiments of the inductor with different shapes, the X direction is different from the Y direction.

Figure 2:
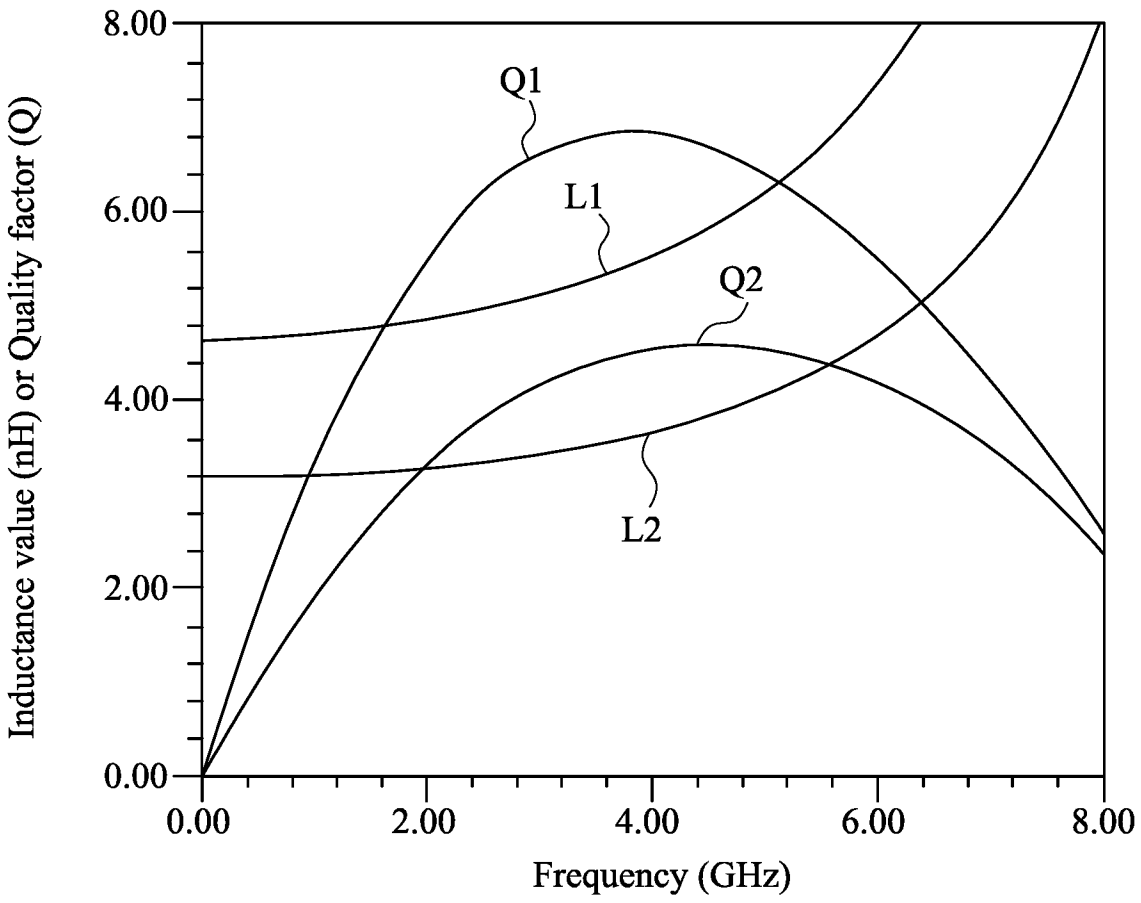
FIG. 2 is the measurement results of the transformer device in FIG. 1A according to some embodiments of the present disclosure.

Referring to FIG. 2, FIG. 2 is the measurement results of the transformer device 100 in FIG. 1A according to some embodiments of the present disclosure. As previously described, the transformer device 100 is formed by asymmetric inductors 110 and 120. As shown in FIG. 2, the inductor curve L1 and the quality factor Q1 of the inductor 110 are different from the inductor curve L2 and the quality factor Q2 of the inductor 120. As shown in FIG. 2, the quality factor of the stacked inductor may be effectively improved by the configuration of the present disclosure. For example, as shown in FIG. 2, when applied to a frequency of 2.4G, the inductance value of the inductor 110 is about 4.93 nanohenry (nH) and has a quality factor of about 6.06. The inductance value of the inductor 120 is about 3.2 nH and has a quality factor of about 3.69. The above values are used for illustration only, and the present disclosure is not limited to the above values.

Figure 3:
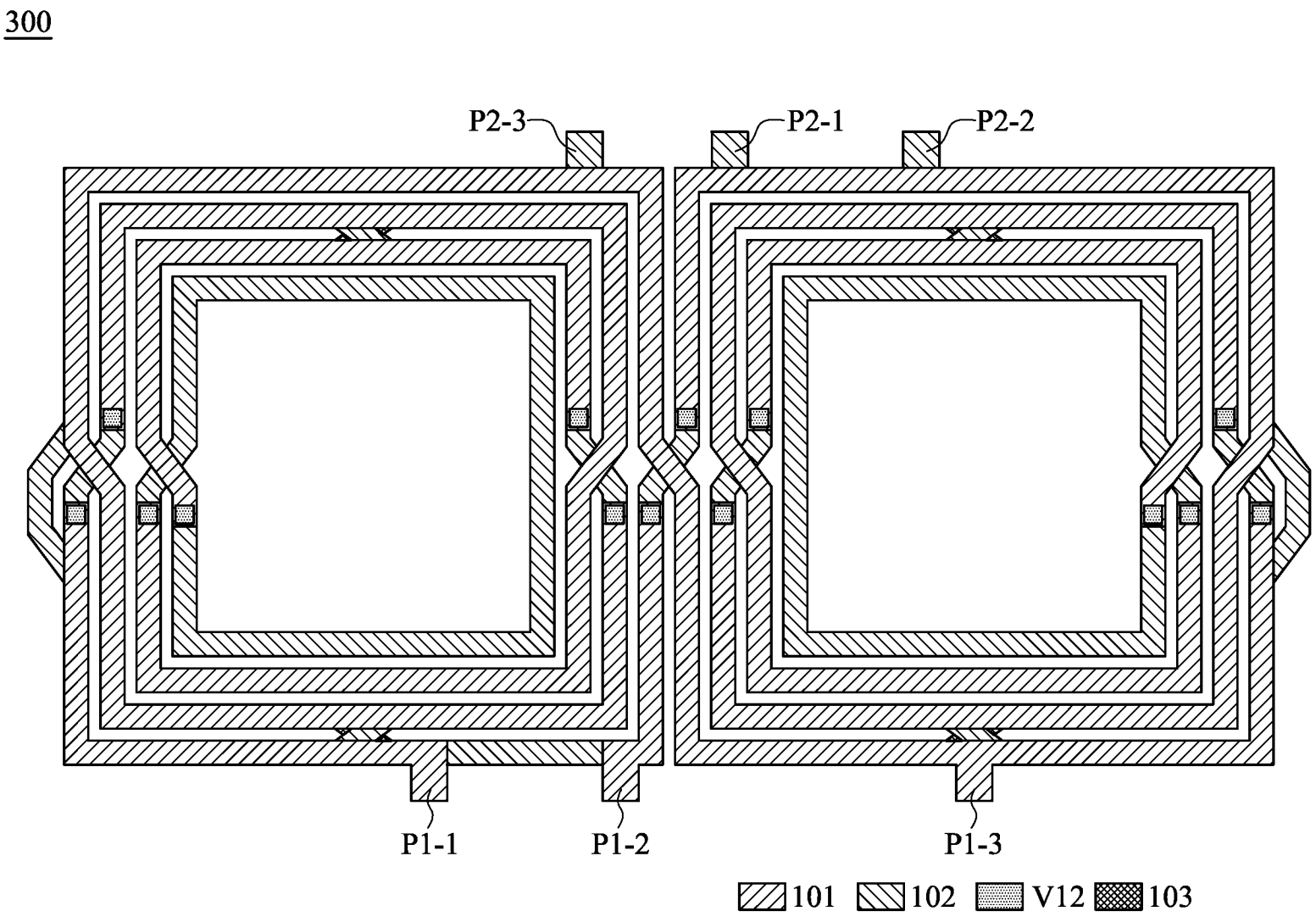
FIG. 3 is a schematic diagram of another configuration of the transformer device in FIG. 1A according to some embodiments of the present disclosure.

Referring to FIG. 3, FIG. 3 is a schematic diagram of another configuration of the transformer device 300 in FIG. 1A according to some embodiments of the present disclosure. Compared with FIG. 1A, in this embodiment, the conductive segments 101 form two spiral coils with 3 turns, and the conductive segments 102 form two spiral coils with 4 turns, to form the transformer device 300 with the ratio of inductance of 3:2. In various different embodiments, the number of turns of the inductor 110 and the number of turns of the inductor 120 may be adjusted based on the actual requirements. Therefore, various turns of the inductors 110 and the inductors 120 are all covered by the present disclosure. In different embodiments, the number of turns of the conductive segments 101 and 102 or the innermost turn thereof provided with or without the vias V12 may be adjusted based on the conditions (e.g., the capacitance and/or quality factors between the inductors).

Figure 4:
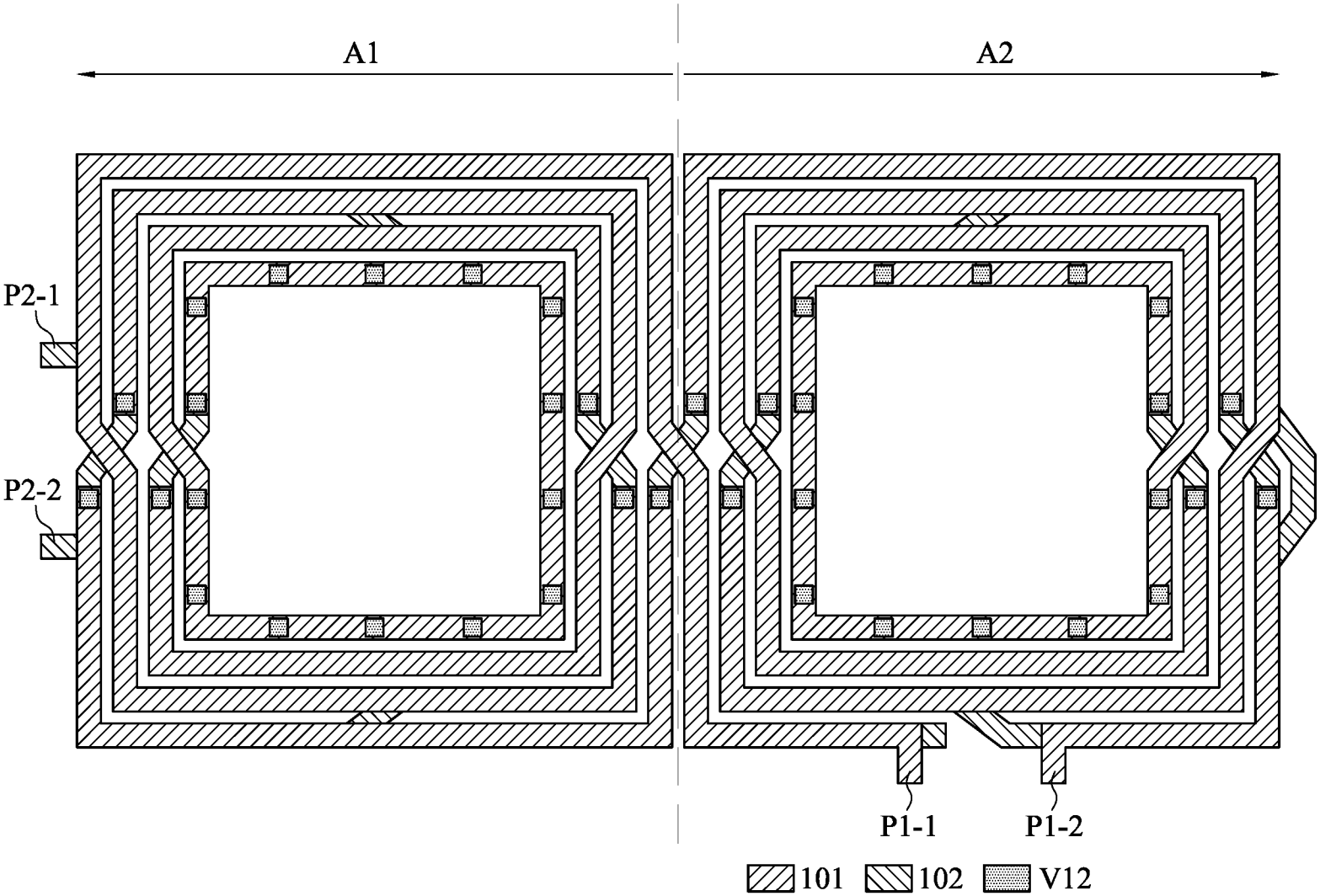
FIG. 4 is a schematic diagram of another configuration of the conductive segments in FIG. 1A according to some embodiments of the present disclosure.

Referring to FIG. 4, FIG. 4 is a schematic diagram of another configuration of the conductive segments 101 and 102 in FIG. 1A depicted according to some embodiments of the present disclosure.

Compared with FIG. 1A, in this embodiment, the first port P1-1 and the second port 1-2 of the inductor 110 are disposed in the second region A2, and the first port P2-1 and the second port P2-2 of the inductor 120 are disposed in the first region A1. In various different embodiments, the positions of the first port P1-1 and the second port 1-2 of the inductor 110 and the first port P2-1 and the second port P2-2 of the inductor 120 may be adjusted based on the actual requirements.

In some embodiments, in the conditions of adopting the center tap, a center tap port (e.g., the third port P1-3 previously described) may be disposed in the middle of the signal path between the first port P1-1 and the second port P1-2, and another center tap port (e.g., the third port P2-3 previously described) may be disposed in the middle of the signal path between the first port P2-1 and the second port P2-2.

Figure 5:
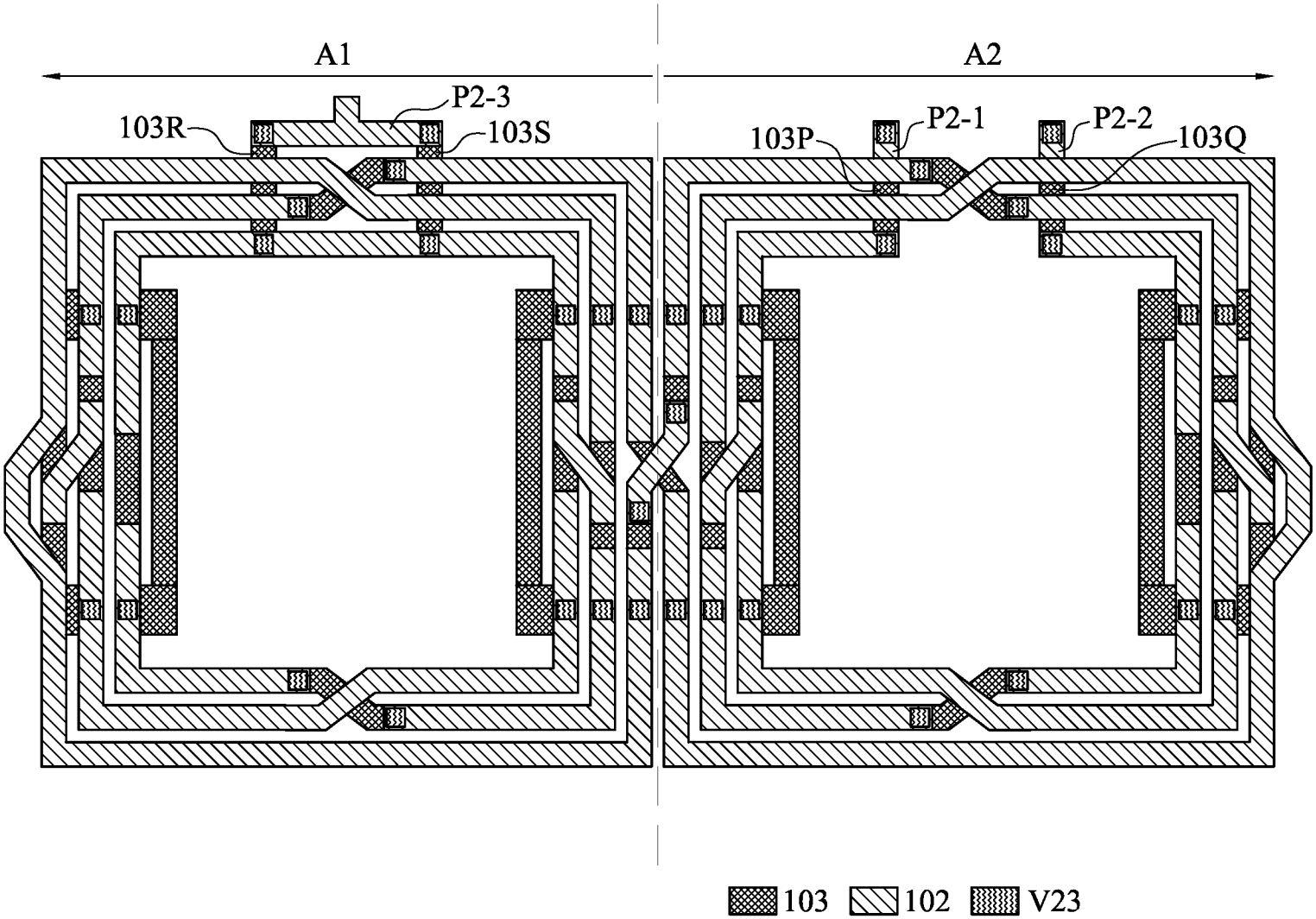
FIG. 5 is a schematic diagram of another configuration of the conductive segments in FIG. 1A according to some embodiments of the present disclosure.

Referring to FIG. 5, FIG. 5 is a schematic diagram of another configuration of the conductive segments 102 and 103 in FIG. 1A depicted according to some embodiments of the present disclosure. In this embodiment, the conductive segments 103 further comprise bridging segments 103P-103S. Each of the two ends of the bridging segment 103P is provided with the via V23 to couple the first port P2-1 to one end of the inner turn of the second region A2. Each of the two ends of the bridging segment 103Q is provided with the via V23 to couple the second port P2-2 to another end of the inner turn of the second region A2. The two ends of the bridging segments 103R and 103S are provided with vias V23 to couple the third port P2-3 to the inner turn of the first region A1.

As previously shown in FIG. 1G, the conductive segments 102 of the inductor 120 are routed from the outer turn to the inner turn in the first region A1, and are routed from the outer turn to the inner turn in the second turn A2. Compared with FIG. 1G, in this embodiment, the conductive segments 102 are routed sequentially from the inner turn to the outer turn in the second region A2 with half of the windings, then routed in the first region A1 with all windings, and then routed in the second region A2 with the remaining windings to form an inductor.

For ease of illustration, the first turn, the second turn, the third turn, and the fourth turn of the multi-turn windings of the coil are from the outside to the inside sequentially, in which the fourth turn is configured to couple to the third turn through the conductive segment 103. As shown in FIG. 5, the conductive segments 102 and 103 are routed from the first port P2-1 sequentially through the bridging segment 103P, a part of the multi-turn windings in the second region A2 (including the left half part of the third turn of the windings, the right half part of the second turn of the windings, and the left half part of the first turn of the windings), the multi-turn windings of the first region A1, another part of the multi-turn windings of the second region A2 (including the right half part of the first turn of the windings, the left half part of the second turn of the windings, and the left half part of the third turn of the windings), and the bridging segment 103Q, and are coupled to the second port P2-2. Based on this configuration, when operated in common mode (i.e., the first port P2-1 and the second port P2-2 receiving current in the same direction), the signal received from the first port P2-1 and the signal received from the second port P2-2 are in opposite current directions within the inductor 120. In this way, the common mode inductance value of the inductor 120 may be lower.

The above arrangement is described with the inductor 120 as an example. In some other embodiments, the inductor 110 may also be adapted to a similar arrangement. That is, the first port P1-1, the second port P1-2, and the third port P1-3 extend from the inner turn through the additional segments, in which the conductive segments 101 may be routed sequentially from the inner turn to the outer turn in the first region A1 with half of the path, then routed around the second region A2, and routed in the first region A1 with the remaining path. In some embodiments, the aforementioned additional segments may be implemented by the conductive segments 102. The arrangement here is similar to the related description in FIG. 5, and thus the description thereof is not repeated here.

Based on the above, in the present disclosure, the conductive segments in the different layers are connected by bridging segments disposed in different directions to form inductors. In this way, the quality factor of the inductor can be effectively improved in a unit area, thereby improving the performance of the transformer device.

Although the present disclosure has been described in considerable detail with reference to certain embodiments thereof, it is not used to limit the present disclosure. It will be apparent to those skilled in the art that various modifications and variations may be made without departing from the scope or spirit of the present disclosure. Thus, the scope of the present disclosure falls within the scope of the following claims.

What is claimed is:

1. A transformer device, comprising:

a plurality of first conductive segments formed on a first metal layer;

a plurality of second segments formed on a second metal layer, the plurality of second segments comprising a plurality of second conductive segments and a plurality of first bridging segments, wherein the plurality of first bridging segments are connected to the plurality of first conductive segments to form a first inductor; and a plurality of third conductive segments formed on a third metal layer, the plurality of third conductive segments comprising a plurality of second bridging segments, wherein the second metal layer is located on the third metal layer, and the plurality of third conductive segments are connected to the plurality of second conductive segments to form a second inductor, wherein the first inductor is located on the second inductor, the plurality of first bridging segments and the plurality of first conductive segments form a plurality of first interlaced portions along a first direction, the plurality of second bridging segments and the plurality of second conductive segments form a plurality of second interlaced portions along a second direction, and the first direction is different from the second direction.

2. The transformer device of claim 1, wherein the plurality of first conductive segments form a first spiral coil in a first region and a second spiral coil in a second region, each of the first spiral coil and the second spiral coil has a plurality of windings, and the first spiral coil and the second spiral coil form the first inductor.

3. The transformer device of claim 2, wherein the first inductor comprises a first port, a second port, and a third port, the plurality of first conductive segments are routed from an outer turn of the first spiral coil to an inner turn of the first spiral coil in the first region, and coupled to an outer turn of the second spiral coil from the first port through a portion of the plurality of first bridging segments, and the plurality of first conductive segments are routed from the outer turn of the second spiral coil to an inner turn of the second spiral coil in the second region, and coupled to the second port from the third port through another portion of the plurality of first bridging segments.

4. The transformer device of claim 3, wherein the third port is configured to operate as a center tap.

5. The transformer device of claim 2, wherein one of the plurality of first bridging segments connects a first turn of the first spiral coil to a second turn of the first spiral coil, and is interlaced with one of the plurality of first conductive segments to form one of the plurality of first interlaced portions.

6. The transformer device of claim 2, wherein a magnetic field generated from the first spiral coil is opposite to a magnetic field generated from the second spiral coil.

7. The transformer device of claim 1, wherein the plurality of second conductive segments form a first spiral coil in a first region and a second spiral coil in a second region, the first spiral coil and the second spiral coil each have a plurality of windings, and the first spiral coil and the second spiral coil form the second inductor.

8. The transformer device of claim 7, wherein the second inductor comprises a first port, a second port, and a third port, the plurality of second conductive segments are routed from an outer turn of the first spiral coil to an inner turn of the first spiral coil in the first region, and coupled to an outer turn of the second spiral coil from the first port through a portion of the plurality of second bridging segments, and the plurality of second conductive segments are routed from the outer turn of the second spiral coil to an inner turn of the second spiral coil in the second region, and coupled to the second port from the third port through another portion of the plurality of second bridging segments.

9. The transformer device of claim 8, wherein the third port is configured to operate as a center tap.

10. The transformer device of claim 7, wherein one of the plurality of second bridging segments connects a first turn of the first spiral coil to a second turn of the first spiral coil, and is interlaced with one of the plurality of second conductive segments to form one of the plurality of second interlaced portions.

11. The transformer device of claim 7, wherein a magnetic field generated from the first spiral coil is opposite to a magnetic field generated from the second spiral coil.

12. The transformer device of claim 1, wherein the plurality of first conductive segments or the plurality of second conductive segments form a first spiral coil in a first region and a second spiral coil in a second region, and the first spiral coil and the second spiral coil each have a plurality of windings, and wherein the plurality of first conductive segments or the plurality of second conductive segments are routed to sequentially form a portion of the plurality of windings of the first spiral coils, the plurality of windings of the second spiral coils, and remaining portions of the plurality of windings of the first spiral coils.

13. The transformer device of claim 12, wherein the plurality of first conductive segments or the plurality of second conductive segments are routed from an inner turn of the first spiral coil to an outer turn of the first spiral coil in the first region, and the plurality of first conductive segments or the plurality of second conductive segments are routed from the inner turn of the second spiral coil to an outer turn of the second spiral coil in the second region.

14. The transformer device of claim 1, further comprising:

a plurality of first vias, wherein the plurality of first vias are configured to correspond to a plurality of end disposed in the plurality of first bridging segments to couple the plurality of first bridging segments to the plurality of first conductive segments; and a plurality of second vias, wherein the plurality of second vias are configured to correspond to a plurality of end configured in the plurality of third conductive segments to couple the plurality of second bridging segments to the plurality of second conductive segments.

15. The transformer device of claim 1, wherein each of the first inductor and the second inductor is a 8-shaped inductor.

16. The transformer device of claim 1, wherein a corresponding one of the plurality of first bridging segments is further configured to bridges the first inductor to the second inductor.

17. The transformer device of claim 1, wherein the first direction is perpendicular to the second direction.

18. The transformer device of claim 1, wherein a resistance value of the first metal layer is lower than a resistance value of the second metal layer, and the resistance value of the second metal layer is lower than a resistance value of the third metal layer.

19. The transformer device of claim 18, wherein the first metal layer is an ultra-thick metal (UTM) layer, and the second metal layer is a redistribution layer.

20. The transformer device of claim 1, wherein the first metal layer is stacked on the second metal layer, and the second metal layer is stacked on the third metal layer.

* * * * *